United States Patent [19]

Utsch et al.

[11] 4,414,987

[45] Nov. 15, 1983

[54] PROCESS FOR INCREASING THE FILLING POWER OF TOBACCO LAMINA FILLER

[75] Inventors: Francis V. Utsch, Midlothian; Roger Z. de la Burde, Powhatan; Patrick E. Aument; Henry B. Merritt, both of Richmond, all of Va.

[73] Assignee: Philip Morris Incorporated, New York, N.Y.

[21] Appl. No.: 294,814

[22] Filed: Aug. 20, 1981

[51] Int. Cl.[3] ..... A24B 3/18

[52] U.S. Cl. ..... 131/296; 131/303; 131/304

[58] Field of Search ..... 131/300–307, 131/291–296, 903

[56] References Cited

U.S. PATENT DOCUMENTS

| | | | |
|---|---|---|---|
| 1,789,435 | 1/1931 | Hawkins | 131/296 |
| 2,344,106 | 3/1944 | Reed | 131/296 |
| 2,596,183 | 5/1952 | Sowa | 131/903 |
| 2,656,841 | 10/1953 | Gurley | 131/296 |
| 3,357,436 | 12/1967 | Wright | 131/303 |
| 3,409,022 | 11/1968 | de la Burde | 131/296 |
| 3,409,023 | 11/1968 | de la Burde | 131/296 |
| 3,409,027 | 11/1968 | de la Burde | 131/296 |
| 3,409,028 | 11/1968 | de la Burde | 131/298 |
| 3,425,425 | 2/1969 | Hind | 131/296 |
| 3,529,606 | 9/1970 | de la Burde et al. | 131/296 |
| 3,734,104 | 5/1973 | Buchanan et al. | 131/296 |
| 3,742,961 | 7/1973 | Waller | 131/296 |
| 3,842,846 | 10/1974 | Laszlo | 131/296 |
| 3,957,063 | 5/1976 | Wochnowski | 131/903 |
| 3,978,867 | 9/1976 | Wochnowski | 131/296 |
| 3,982,550 | 9/1976 | de la Burde et al. | 131/296 |
| 4,040,431 | 8/1977 | Ashworth et al. | 131/296 |
| 4,044,780 | 8/1977 | Kelly | 131/296 |
| 4,161,953 | 7/1979 | Glock | 131/296 |
| 4,195,647 | 4/1980 | Wochnowski | 131/296 |
| 4,211,243 | 7/1980 | Ohno et al. | 131/296 |
| 4,235,249 | 11/1980 | Psaras et al. | 131/296 |
| 4,235,250 | 11/1980 | Utsch | 131/296 |
| 4,244,381 | 1/1981 | Lendvay | 131/296 |
| 4,366,825 | 1/1983 | Utsch et al. | 131/296 |

FOREIGN PATENT DOCUMENTS

| | | | |
|---|---|---|---|
| 624477 | 11/1962 | Belgium . | |
| 977235 | 11/1975 | Canada | 131/296 |
| 980206 | 12/1975 | Canada | 131/296 |
| 1138899 | 1/1969 | United Kingdom . | |
| 1293735 | 7/1972 | United Kingdom | 131/296 |
| 1280684 | 10/1972 | United Kingdom | 131/296 |
| 2004999 | 4/1979 | United Kingdom . | |

OTHER PUBLICATIONS

"Das Trocknen" Von Dr. Ing. Kneule, published by Aarau et al., 1975, p. 148.

*Primary Examiner*—V. Millin

*Attorney, Agent, or Firm*—Robert M. Shaw

[57] ABSTRACT

A process is disclosed for increasing the filling power of tobacco lamina filler without the use of exogenous impregnants by contacting the filler with a heat transfer medium such that heat is transferred rapidly and substantially uniformly from the medium to the filler for a total contact time sufficient to stiffen and expand the filler. The filler has an OV value, immediately before treatment, within the range of from about 8% to about 30% and, most preferably, within the range of from about 10% to about 14%. The filler, immediately before treatment, is preferably at ambient temperature and it is preferred that the entire process be conducted at atmospheric pressure.

10 Claims, No Drawings

PROCESS FOR INCREASING THE FILLING POWER OF TOBACCO LAMINA FILLER

BACKGROUND OF THE INVENTION

This invention relates to the art of increasing the filling power of tobacco filler. More particularly, this invention relates to a process whereby the filling power of tobacco filler is increased without the use of exogenous puffing or blowing agents.

During curing, the moisture content of tobacco leaves is greatly reduced resulting in shrinkage of the leaf structure and a decrease in filling power. Additionally, the shredding or cutting techniques generally employed to convert the cured tobacco leaves into filler may result in some lamination and compression of the tobacco, thereby decreasing the filling power even further. Many processes have been devised for increasing the filling power of cured tobacco for reasons well known in the art.

The heretofore known processes may be broadly characterized as involving penetration or impregnation of the tobacco with impregnants (blowing or puffing agents) which when removed during a subsequent expansion process step generate elevated pressure in the tobacco cells to expand the cell walls resulting in an expansion of the tobacco. The impregnant may be a solid, a liquid, or a gas. Most often, such an expansion process involves generating and expanding a gas or, in the case of a gaseous impregnant, simply causing the gas to expand, within the cell, thereby causing expansion of the cell volume. The rate of expansion or generation and expansion of the gas thus has to be greater than the rate at which it is removed by diffusion through the cell walls, but the maximum resulting pressure has to be less than the bursting strength of the cell structural elements.

Among the impregnants which have been employed are pressurized steam, air, water, organic solvents, ammonia, carbon dioxide, combinations of ammonia and carbon dioxide, and compounds capable of liberating a gas when subjected to chemical decomposition, as by heating. Among the means disclosed for removing the impregnant to expand the cell walls are a sudden reduction in pressure, freeze-drying, convection heating, radiant transfer (infrared), and the application of a microwave field.

Impregnants such as water, alcohol, acetone, a volatile hydrocarbon or a volatile halogenated hydrocarbon, which may also be employed as solvents for the gas-releasing compounds, may be applied to the tobacco by spraying, sprinkling or dipping in any desired manner. In such cases, thorough and rapid impregnation may be further assisted if the tobacco is subjected to subatmospheric pressure to expel a portion of the air from the tobacco particle interstices before it is contacted with the impregnating solution. It is generally preferred in the art to incorporate gas-releasing impregnants into the tobacco in the liquid condition in order that uniform impregnation of the tobacco may be achieved, but in certain cases, the gas-releasing chemical may be formed in situ within the tobacco or may be applied to the tobacco in the dry state, e.g., by dusting or otherwise.

While a number of the known processes may be employed to provide a satisfactory expanded tobacco product, which may then be blended with an unexpanded tobacco and formed into cigarettes or the like, the known processes do possess certain disadvantages. Thus, the use of certain impregnants, such as halogenated hydrocarbons, which are foreign to tobacco may not be completely satisfactory, because some of the materials employed are not always desired as additives and the introduction, in considerable concentration, of such foreign materials presents the problem of removing the expansion agent after the treatment has been completed in order to avoid affecting aroma and other properties of the smoke. Moreover, aside from the aforementioned disadvantages, the use of such foreign materials adds to the overall cost of producing tobacco end products.

Processes employing water as an impregnant have tended to produce a more satisfactory result with tobacco stems than with tobacco lamina filler. It may be that the greater permeability of the leaf structure permits the water impregnant to escape before substantial expansion can take place. Removal of the water impregnant by freeze-drying is not only a comparatively slow and expensive approach but may result, in some instances, in a product which has an objectionable amount of tackiness because of the hygroscopicity of a film-like layer of water-extracted solids which forms on the surface of the tobacco. Removal of the water impregnant using a microwave field also requires elaborate and expensive equipment and may tend to be more effective with tobacco stems than with tobacco lamina filler.

Impregnating tobacco with air, carbon dioxide or steam, under pressure, and then suddenly releasing the pressure to expand the tobacco is not generally satisfactory since the volume of the tobacco is only slightly or, at best, only moderately increased, for example, by about 3 to 15 percent. Additionally, the process may result in shattering the tobacco structure and particles so that considerable waste, incident to the formation of fines, results.

One particular difficulty with the impregnation processes in which the impregnant is removed during a subsequent expansion step is that the degree of expansion which results during removal of the impregnant may not be readily controlled. As a consequence, present practice generally requires that tobacco that has been treated to increase its filling capacity, as by being expanded, be blended with unexpanded tobacco. This is undesirable, particularly since it requires an extra blending step and the maintenance of separate storage facilities for the treated and untreated tobacco.

It has now been discovered that tobacco lamina filler may be stiffened and expanded to increase its filling power without the use of an exogenous impregnant by contacting the filler with a heat transfer medium such that heat is rapidly and substantially uniformly transferred from the medium to the filler for a time sufficient to stiffen and expand the filler and that this process is effectively employed with filler having an OV value, before treatment, within the range of from about 8% to about 30%. Among the advantages to be realized are that the degree of expansion may be controlled so that not only increases in cylinder volume in excess of 70% over the unexpanded cylinder volume may be consistently achieved, but also moderate expansion may be selected thus eliminating the need to blend the expanded filler with unexpanded filler, if that is desired. An additional advantage is that the filler expanded according to the process of the present invention is substantially stable in that little, if any, collapse is experienced during reordering. Yet another advantage is that the process may be effectively employed at atmospheric pressure.

DEFINITIONS

As used herein, the following terms have the indicated meanings.

Filling Power

The ability of tobacco to form a firm cigarette rod at a given moisture content. A high filling power indicates that a lower weight of tobacco is required to produce a cigarette rod than is required with a tobacco of lower filling power. Filling power is increased by stiffening tobacco and also by expanding tobacco.

Cylinder Volume (CV)

The volume that a given weight of shredded tobacco occupies under a definite pressure. The CV value is expressed as cc/10 g. To determine this value, tobacco filler weighing 10.000 g is placed in a 3.358-cm diameter cylinder, vibrated for 30 seconds on a "Syntron" vibrator, and compressed by a 1875 g piston 3.33 cm in diameter for 5 minutes; the resulting volume of filler is reported as cylinder volume. This test is carried out at standard environmental conditions of 23.9° C. and 60% relative humidity (RH). A high Cylinder Volume indicates a high Filling Power.

Equilibrium Cylinder Volume (CVeq.)

The cylinder volume determined after the tobacco filler has been equilibrated by conditioning at 23.9° C. and 60% RH for 18 hours.

Oven-Volatiles Content (OV)

A unit indicating the moisture content (or percentage of moisture) in tobacco filler. It is determined by weighing a sample of tobacco filler before and after exposure in a circulating air oven for three hours at 100° C. The weight loss as a percentage of initial weight is the oven-volatiles content. The weight loss is attributable to volatiles in addition to water but OV is used interchangeably with moisture content and may be considered equivalent thereto since, at the test conditions, not more than about 1% of the tobacco filler weight is volatiles other than water.

Equilibrium Oven-Volatiles Content ($OV_{eq.}$)

The OV value determined after the tobacco filler has been equilibrated by conditioning at 23.9° C. and 60% RH for 18 hours.

Specific Volume (SV)

The volume of a predetermined amount of tobacco divided by the weight of the tobacco. The SV value is expressed as cc/g and may be determined by a simple application of the weight in air vs. weight in liquid method by placing a one-gram sample of tobacco in a tea ball which is then weighed, submerged in a liquid, and reweighed. The liquid employed is often indicated as a subscript. Thus, with acetone as the liquid the abbreviation would be "$SV_{acetone}$" and, with mercury, "$SV_{Hg}$". Specific Volume differs from Cylinder Volume in that the tobacco is not compressed. It has been observed that as Specific Volume increases, Filling Power also increases.

Equilibrium Specific Volume ($SV_{eq}$)

The SV value determined after the tobacco filler has been equilibrated by conditioning at 23.9° C. and 60% RH for about 18 hours.

Tobacco Lamina Filler

Shredded, cured tobacco exclusive of the stems (or veins). The cured tobacco may be of any type, and may be cased or uncased. Burley, Bright, Oriental and blends thereof are preferred.

Exogenous Impregnant

A substance in solid, liquid or gaseous form, other than water, which is added to tobacco for its function as a blowing or puffing agent during an expansion step.

REPORTED DEVELOPMENTS

U.S. Pat. No. 3,842,846 discloses a process for expanding tobacco leaf in whole or cut form in which the tobacco is first impregnated with a suitable liquid such as water alone or a salt solution so that it has a moisture content, expressed as oven-volatiles, within the range of about 20% to about 60% total weight basis, preferably about 40% total weight basis. The impregnated tobacco is then introduced into a water vapor containing zone wherein the relative humidity is at least 40% and preferably within the range of 40% to 100% and wherein the temperature is within the range of about 75° C. to about 150° C. The impregnated tobacco is exposed to microwave energy within this zone to evaporate the water in the tobacco with the pressure thereof and rate of evaporation expanding the tobacco cell walls and thus puffing the tobacco. The total time exposure of the tobacco to the microwave energy is within the range of about 0.05 to about 5.0 minutes, with a range of 0.05 to 0.15 minutes being preferred. Increases in filling power of from 15% to 50% are disclosed.

U.S. Pat. Nos. 4,040,431 and 4,044,780 disclose, respectively, a method, and an apparatus useful in practicing that method, of increasing the filling capacity of shredded tobacco, including total blends. As an initial and essential step, the tobacco is conditioned to effect an opening of the tobacco which has been compressed during cutting by increasing its moisture content to at least about 15%, with an upper moisture level being preferably about 35% and with a preferred range being 22% to 26%, and to increase its temperature to at least about 130° F. to 250° F., preferably within the range of 180° F. to 200° F. The tobacco is then promptly dried in the form of a substantially continuous thin laminar flow in a hot gas to a moisture content of about 11% to 16% in a period of less than about 5 seconds and preferably less than about 2 seconds. Increases in filling capacity of from about 5% to 25% over untreated tobacco are disclosed.

SUMMARY OF THE INVENTION

The present invention relates to a process for increasing the filling power of tobacco lamina filler by contacting tobacco lamina filler with a heat transfer medium such that heat is rapidly and substantially uniformly transferred from the medium to the filler for a total contact time sufficient to stiffen and expand the filler. The entire process is preferably conducted at atmospheric pressure. The tobacco lamina filler (also referred to hereinafter as "the filler"), immediately before it is treated by being contacted with the heat transfer medium, is free of exogenous impregnants and has an OV value within the range of from about 8% to about 30%, preferably from about 10% to about 20%, and more preferably from about 10% to about 14%. The total contact time will vary depending on the degree of expansion desired, the initial OV value of the tobacco, and the rate of heat transfer. As an upper limit, the total contact time has a practial limit at the point at which burning of the tobacco occurs.

DESCRIPTION OF THE INVENTION

According to the present invention, a process is provided for increasing the filling power of tobacco lamina filler without the use of exogenous impregnants and which may be effectively employed at atmospheric pressure.

The filler may be from any cured tobacco whether cased or not, and is preferably from the group consisting of Burley, cased Burley, Bright, cased Bright, Oriental and cased Oriental lamina filler, and mixtures thereof. More preferably, the lamina filler is selected from the group consisting of Burley, cased Burley, Bright, and cased Bright Lamina filler, and mixtures thereof. Whatever its source, the filler for use in the process of the invention, immediately before treatment, is free of exogenous impregnants and has a moisture content or OV value within the range of from about 8% to about 30%, preferably from about 10% to about 20%, and more preferably from about 10% to about 14%. Also, it is preferred that the filler be at ambient temperature immediately before treatment.

When tobacco is cut or shredded to produce the lamina filler, it typically leaves the cutter at a moisture content (OV) within the range of from about 18% to about 30%. Thus the filling power of cut filler may be increased according to the process of the invention without first reducing or increasing its moisture content. But where immediate expansion of the filler is not contemplated, it is typically dried to an OV value of about 12% to prevent molding. The process of the present invention surprisingly allows tobacco filler even at this relatively low moisture content to be expanded without first increasing its moisture content.

While it is contemplated that tobacco lamina filler having OV values below about 8% may be employed in the present process, the practical limitations imposed by the increasing brittleness of and difficulty in handling the tobacco as the moisture content decreases lead to results which may not be as consistent and as desirable as those obtained when unimpregnated tobacco lamina filler having a moisture content of at least about 8% is employed. As the upper limit of about 30% is exceeded, the higher moisture content requires that more heat energy be transferred to the tobacco in order to remove this excess moisture.

It is a surprising aspect of the present invention that tobacco lamina filler is significantly expanded even though it is free of exogenous impregnants and though it has an OV value, immediately before treatment, even within the more preferred range of from about 10% to about 14%. The use of filler having high OV values, which is undesirable in terms of high energy costs, may thus be avoided when employing the process of the present invention.

The filler is contacted with a heat transfer medium such that heat is rapidly and substantially uniformly transferred from the medium to the filler for a total contact time sufficient to stiffen and expand the filler. It has been discovered that the combination of rapid and substantially uniform heat transfer with the relatively low initial moisture content of the tobacco results in a stiffening and expansion of the tobacco which combine to produce significant increases in filling power. It has been observed that the rate of heat transfer must be rapid in order to achieve the stiffening, or modulus change, and the expansion, or geometric change.

It is believed that if the water activity of the tobacco, which is related to its moisture content, is within a certain range, then, when heat is rapidly and substantially uniformly transferred to the tobacco, certain reactions occur among the endogenous components of the tobacco cells which result in a stiffening of the tobacco tissue and an increase in filling power. These reactions are believed to be optimized when the water activity (i.e., the relative humidity (RH) with which the tobacco is in equilibrium at a given temperature in a closed system) is within the range of from about 30% to about 90%, preferably about 40% to about 90%, and more preferably about 50% to about 75%. For purposes of comparison, this range of about 30% to about 90%, at 75° F., corresponds to a range of OV values of from about 8% to about 30%; a preferred OV range being from about 10% to about 20%, and a more preferred range being from about 10% to about 14%, with the lower OV values yielding the optimal increases in filling power. When filler having an OV value in excess of 20% and, more particularly, in excess of 30% is employed, the water activity is such that it is believed that the rate of the stiffening reactions is significantly reduced.

In order to obtain a constant and optimal result, it is important that the heat be substantially uniformly transferred to the filler. Thus, the filler must be contacted with the heat transfer medium in such a way as to provide a substantially uniform contact between the shreds and the heat transfer medium. If such steps are not taken to insure substantially uniform heat transfer, the product will only be partially stiffened and expanded and thus will contain portions of filler which may be considered to be untreated.

The rate of heat transfer is generally independent of the type of apparatus employed and though a means has not been devised by which the rate may be directly measured, the optimum rate of heat transfer may be established experimentally by adjusting the various operating parameters of the apparatus employed such that the treated filler has an OV value, immediately after being contacted with the heat transfer medium, of less than about 7%, preferably less than about 5% and more preferably less than about 3%. It is particularly preferred that the OV value be within the range of from about 0.5% to about 4% immediately after being contacted with the heat transfer medium. A preferred minimum OV value is about 0.5%.

The post-treatment OV value of the filler is not, in and of itself, a critical parameter since the OV value of the filler may be gradually decreased to within that range over a period of hours, days, or even months without expansion of the filler. But, provided that an apparatus has been selected in which the filler may be substantially uniformly contacted with the heat transfer medium and provided that a heat transfer medium has been selected that permits a rapid transfer of heat to the filler, then, by adjusting the heat content of the heat transfer medium and the total contact time of the filler with the medium, the post-treatment OV value will be within the aforementioned range when the parameters have been properly selected to provide a rapid and substantially uniform transfer of heat from the medium to the filler.

The total contact time will be short enough that the total heat transferred to the filler is less than the amount which will result in burning or otherwise discoloring the filler and yet long enough to provide sufficient transfer of heat from the heat transfer medium to the filler to allow the stiffening reactions to proceed essentially to completion at the selected water activity value and to allow expansion to occur. The total contact time is also preferably as short as possible in order to minimize the loss of alkaloids which are increasingly lost with increasing tobacco temperature. As the rate of heat transfer or the heat content of the medium increases, the contact time will decrease.

Generally, the total contact time will be less than about 4 seconds and may be as low as 0.1 second. Total contact times of up to about 10 seconds have been employed but particularly good results have been observed when employing total contact times within the range of from 0.1 second to about 6 seconds and more particularly within the range of from 0.1 second to about 4 seconds. A preferred minimum contact time is about 1 second.

When fillers are employed that have a high water activity value, corresponding to OV values in excess of 20% and more particularly in excess of 30%, the total heat which must be transferred to the filler is greatly increased since a large portion of the transferred heat is required to evaporate the excess water.

The heat transfer medium is a solid or a gas which has a sufficiently high specific heat to allow rapid transfer of its heat content to the filler when it is contacted therewith. The heat transfer medium may also be a beam of energy such as a beam of radiant energy. One preferred heat transfer medium is a high velocity gas at elevated temperature, such as a gas comprising at least about 50% steam, preferably at least about 80% steam, and having a temperature of at least about 450° F. The rate of heat transfer from such a gas will vary depending on the percent steam content, the gas velocity, and the temperature, all of which are interrelated. Preferably, the filler is contacted with the gas by being substantially uniformly dispersed therein. Another preferred heat transfer medium is radiant energy such as infrared energy, and preferably, the filler is contacted with the radiant energy by being substantially uniformly exposed thereto.

Any apparatus which may be adjusted or adapted to rapidly and substantially uniformly transfer heat from the heat transfer medium to the filler and which allows the total contact time to be controlled, may be employed. One suitable apparatus is a dispersion dryer, which is generally known in the art as a "tower". Another apparatus which may be employed is an image furnace which is essentially a parabolic mirror wherein radiant energy is focused at one focal point and the filler is substantially uniformly contacted with the reflected and forced radiant energy by being transported past the second focal point for a total contact time sufficient to stiffen and expand the filler.

When the process of the present invention is practiced employing a tower, the various parameters, such as the tobacco rate, must be adjusted and/or the tower must be adapted to provide for a substantially uniform transfer of heat from the heat transfer medium to the filler at the optimum rate of heat transfer. When operating a relatively small tower, such as a 3" or an 8" tower, substantially uniform transfer of the heat from the gaseous medium to the filler may be realized by adjusting the tobacco feed rate so that the tobacco is substantially uniformly dispersed in the gaseous medium and the optimum heat transfer rate may be established by adjusting the temperature, velocity, and steam content of the gaseous medium to provide a rapid and optimum rate of heat transfer at the selected moisture content, or water activity, of the filler.

By way of example, with a 3" or an 8" diameter tower, to establish an optimum rate of heat transfer and a substantially uniform heat transfer, the gaseous medium will comprise at least about 50% steam, preferably dry steam, with higher volumes of steam being preferred; the velocity of the gaseous medium will be at least about 40 ft./sec. and preferably about 100 ft./sec. to about 170 ft./sec.; and the temperature of the gaseous medium will be at least about 450° F., preferably within the range of from about 450° F. to about 750° F. and, more preferably, within the range of from about 550° F. to about 675° F. Total contact times will generally be within the range of from about 1 second to about 6 seconds, preferably from about 1 second to about 4 seconds, and the tobacco feed rate will preferably be within the range of from about 0.4 lbs./min. to about 3 lbs./min.

It is to be understood that the steam content, temperature, and velocity are selected to provide the optimum rate of heat transfer for the selected heat transfer medium and tower and that the feed rate is selected for the particular tower to provide substantially uniform contact of the filler with the heat transfer medium. With the 3" and 8" towers, when the various parameters are selected to provide for contact of the filler with the heat transfer medium such that heat is rapidly and substantially uniformly transferred from the medium to the filler, the OV value of the treated filler will generally be within the range of from about 0.5% to about 5%. If the process is scaled up to commercial operation employing larger towers, the various parameters must be adjusted and, in some instances, it is contemplated that the structure of the tower will have to be adapted to provide for the optimum rate of heat transfer. The optimum rate of heat transfer will be substantially the same regardless of the tower employed.

The optimum rate of heat transfer is essentially independent of the type of apparatus employed, and thus the various adjustments and adaptations which are made will be to establish this optimal rate in the apparatus selected. Additionally, the water activity ranges are essentially independent of the type of apparatus employed.

When tobacco has been expanded, the resulting filler is much drier than desired for further processing or use. Therefore, to avoid breakage and to insure satisfactory smoking qualities, it is preferred that the expanded tobacco material be reordered (rehumidified) to a moisture level in equilibrium with normal use conditions before it is handled and processed. Typically, the expanded tobacco product will be reordered to an OV value within the range of from about 8% to about 13%. Any conventional means known to the art, which does not adversely affect maintenance of the expanded state of the filler, may be employed.

The process of the present invention results in an expanded product which not only exhibits a large increase in $CV_{eq}$ over the $CV_{eq}$ of the product before expansion, increases of as much as 177% have been observed and increases in excess of 60% may be consistently achieved, but also exhibits an increase in SV, stiffness, and thickness relative to the product before expansion. The expanded product is substantially stable since the $CV_{eq}$ of the product is only slightly decreased by reordering, Since the process of the present invention may be effectively employed with either cased or uncased tobacco lamina filler, various flavorings and additives generally employed in the art may be applied to the tobacco prior to expansion.

The product obtained according to the process of the present invention may be used to manufacture cigarettes in the conventional manner, or it may be mixed with other tobaccos to provide a desired blend for use in the manufacture of cigarettes or other smoking articles. The expanded filler is particularly suited to being incorporated in cigarettes since no materials foreign to the tobacco are used in the expansion process and thus no residual foreign material is left in the expanded filler to affect taste during smoking. Thus the present invention includes within its scope both the expanded filler produced according to the present invention and also smoking articles, such as cigarettes, which include the expanded filler.

The process of the present invention may be employed to produce an expanded filler, or filler blend, having a pre-selected $CV_{eq}$ value. Thus a totally expanded product may be produced for incorporation directly into cigarettes or the like which does contain any residue from foreign materials added as impregnants which can adversely affect the flavor of the product during smoking.

The following examples present illustrative but non-limiting embodiments of the present invention. Comparative examples are also presented.

EXAMPLES

Tobacco lamina filler free of exogenous impregnants was employed in each example unless otherwise indicated.

EXAMPLE 1

Samples of bright filler having an initial $CV_{eq}$ value of 32 cc/10 g, an $OV_{eq}$ value, immediately before treatment, of 11.8% and an initial $SV_{eq}$ value of 0.9 cc/g were contacted with 100% steam in a 3" diameter tower, equipped with a cyclone separator, for a total contact time of about 3 to 4 seconds, at two different temperatures. The steam velocity was about 130 ft/sec. and the tobacco feed rate was 150 g/min. Another sample having an initial $OV_{eq}$ value of 12.1%, an initial $CV_{eq}$ value of 33 cc/10 g and an initial $SV_{eq}$ value of 0.9 cc/g was treated under conditions identical to the aforementioned conditions but only at 550° F. The results are summarized in Table I below.

TABLE I

| Treatment Temperature | Feed OV, % | Exit OV, % | $CV_{eq}$ cc/10g | $OV_{eq}$, % | $SV_{eq}$ cc/g |
|---|---|---|---|---|---|
| Untreated Control | 11.8 | — | 32 | 11.8 | 0.9 |
| 550° F. | 11.8 | 2.7 | 60 | 10.1 | 1.4 |
| 600° F. | 11.8 | 2.2 | 69 | 9.5 | 1.8 |
| Untreated Control | 11.2 | — | 33 | 12.1 | 0.9 |
| 550° F. | 11.2 | 3.1 | 59 | 10.8 | 1.5 |

EXAMPLE 2

Samples of Bright filler were contacted with 100% steam in a 3" tower, equipped with a cyclone separator, for a total contact time of about 3 to 4 seconds. The steam velocity was 125 ft/sec. and the tobacco feed rate was 150 g/min. The input OV values and the treatment temperatures were as appear in Table II below, and the results are summarized in the same Table.

TABLE II

| Input OV, % | Treatment Temperature | Exit OV, % | $OV_{eq}$, % | $CV_{eq}$ cc/10g |
|---|---|---|---|---|
| 11.0 | Untreated Control | — | 11.93 | 34.7 |
| | 625° F. | 1.1 | 9.55 | 79.7 |
| | 625° F. | 2.4 | 9.65 | 75.7 |
| | 600° F. | 2.2 | 9.70 | 74.2 |
| | 550° F. | 3.4 | 9.85 | 61.3 |
| | 500° F. | 4.1 | 10.65 | 43.2 |
| 18.4 | Untreated Control | — | 12.0 | 33.2 |
| | 625° F. | 1.8 | 10.3 | 65.2 |
| | 600° F. | 1.9 | 9.2 | 67.3 |
| | 550° F. | 2.2 | 11.0 | 46.5 |
| 31.4 | Untreated Control | — | 12.02 | 33.7 |
| | 640° F. | 5.1 | 10.4 | 66.7 |
| | 620° F. | 4.6 | 10.3 | 64.0 |
| | 600° F. | 5.0 | 10.9 | 56.0 |
| | 520° F. | 4.7 | 11.1 | 52.4 |

EXAMPLE 3

Samples of tobacco filler at various initial OV values were treated at various temperatures by being contacted with 100% steam in a 3" tower equipped with a cyclone separator for a total contact time of about 3 to 4 seconds. The tobacco feed rate was about 150 g/min., and the steam velocity was about 130 ft/sec. The treatment conditions and the results are summarized in Table III below.

TABLE III

| Treatment Temperature | Feed OV, % | Dry* Bulb, °F. | Wet* Bulb, °F. | RH*, % | Baro-* metric press., in. Hg | Exit $OV_{eq}$, % | $OV_{eq}$, % | $CV_{eq}$, cc/10g |
|---|---|---|---|---|---|---|---|---|
| Untreated Control | 11.2 | 73.5 | 56.5 | 32.7 | 29.94 | — | 12.35 | 36.1 |
| 576° F. | | 73.5 | 56.5 | 32.7 | 29.94 | 2.6 | 10.95 | 70.1 |
| 575° F. | | 77.5 | 65 | 50.9 | 29.52 | 2.3 | 11.21 | 66.1 |
| Untreated Control | 11.8 | 77 | 68 | 63.0 | 29.91 | — | 13.60 | 31.9 |
| 573° F. | | 77 | 68 | 63.0 | 29.91 | 2.6 | 11.61 | 61.2 |
| 571° F. | | 79 | 68 | 56.8 | 30.00 | 2.4 | 10.83 | 67.0 |
| Untreated Control | 12.1 | 76 | 69 | 70.1 | 29.88 | — | 13.06 | 33.2 |
| 572° F. | | 76 | 69 | 70.1 | 29.88 | 2.0 | 11.16 | 66.2 |

TABLE III-continued

| Treatment Temperature | Feed OV, % | Dry* Bulb, °F. | Wet* Bulb, °F. | RH*, % | Baro-* metric press., in. Hg | Exit $OV_{eq}$, % | $OV_{eq}$, % | $CV_{eq}$, cc/10g |
|---|---|---|---|---|---|---|---|---|
| 572° F. | | 78 | 69 | 63.4 | 29.99 | 2.4 | 11.28 | 61.7 |
| Untreated Control | 12.4 | 78 | 70 | 67.5 | 29.80 | — | 12.68 | 36.9 |
| 592° F. | | 78 | 70 | 67.5 | 29.80 | 3.2 | 10.83 | 64.2 |
| 596° F. | | 76 | 69 | 70.1 | 29.88 | 2.4 | 10.78 | 71.1 |
| Untreated Control | 12.6 | 72 | 54.5 | 29.5 | 29.43 | — | 13.33 | 32.1 |
| 576° F. | | 72 | 54.5 | 29.5 | 29.43 | 1.8 | 11.60 | 58.8 |
| 574° F. | | 69 | 55 | 39.0 | 30.09 | 1.6 | 11.93 | 59.8 |
| Untreated Control | 12.8 | 77 | 65 | 51.9 | 29.66 | — | 12.62 | 35.8 |
| 576° F. | | 77 | 65 | 51.9 | 29.66 | 2.4 | 11.24 | 64.9 |
| 576° F. | | 73.5 | 56.5 | 32.7 | 29.94 | 2.8 | 10.98 | 67.7 |
| Untreated Control | 14.6 | 79 | 68 | 56.8 | 30.00 | — | 14.09 | 28.7 |
| 571° F. | | 79 | 68 | 56.8 | 30.00 | 2.4 | 11.57 | 55.4 |
| 573° F. | | 80 | 67 | 50.6 | 29.67 | 2.5 | 11.08 | 59.0 |

*Pilot plant conditions during treatment.

EXAMPLE 4

Bright tobacco lamina filler having an initial OV value of 11.8%, an initial $CV_{eq}$ value of 36.8 cc/10 g and an initial $OV_{eq}$ value of 12.6% was contacted with 100% steam in a 3" tower, equipped with a cyclone separator, at a temperature of 316° C., a steam velocity of 140 ft./sec., and a tobacco feed rate of 150 g/min. The total contact time was about 4 seconds. The expanded tobacco exiting the tower had an OV value of 1.9% and, upon equilibration, a $CV_{eq}$ value of 64.6 cc/10 g and an $OV_{eq}$ value of 10.9%.

EXAMPLE 5

Samples of uncased burley filler tobacco and samples of uncased bright filler tobacco were contacted with 100% steam in a 3" tower, equipped with a cyclone separator, at a feed rate of 180 g/min., a steam velocity of about 130 ft/sec. and for a total contact time of about 4 seconds. Samples were run at three different temperatures. The initial CV and OV values for the burley filler and bright filler were 34.1 cc/10 g at 15.2% OV and 42.1 cc/10 g at 11.2% OV, respectively. The treated samples were equilibrated and the equilibrium CV and OV values, as well as the SV values in both acetone and mercury, determined. The filler thickness was determined as the average of 25 random measurements per sample. As controls, these values were also determined for untreated samples. The percent increase in CV and $SV_{acetone}$ relative to the control were calculated. The results are summarized in Table IV below.

TABLE IV

| Treatment Temperature | Tower Exit OV, % | Equ. CV/OV cc/10g/% | $SV_{acetone}$ cc/g | $SV_{Hg}$ | % increase, relative to control, in CV | % increase, relative to control, in $SV_{acetone}$ | Filler Thickness, $10^{-6}$m |
|---|---|---|---|---|---|---|---|
| | | Uncased Burley filler, Feed OV = 15.2% | | | | | |
| Untreated Control | — | 42.4/11.8 | 0.91 | 1.34 | — | — | 74 |
| 550° F. | 3.1 | 73.0/10.5 | 1.40 | 1.86 | 72 | 54 | 106.4 |
| 625° F. | 2.6 | 91.3/9.4 | 2.12 | 2.88 | 115 | 133 | 146.8 |
| 675° F. | 3.0 | 98.5/9.5 | 2.71 | 2.97 | 132 | 198 | 165.6 |
| | | Uncased Bright filler, Feed OV = 11.2% | | | | | |
| Untreated Control | — | 40.5/11.8 | 0.92 | 1.06 | — | — | 124.8 |
| 550° F. | 2.5 | 77.3/9.8 | 1.80 | 2.26 | 91 | 96 | 137.2 |
| 625° F. | 2.5 | 91.3/9.8 | 2.53 | 3.11 | 125 | 175 | 180.0 |
| 675° F. | 2.2 | 112.0/9.4 | 3.14 | 3.98 | 177 | 241 | 236.4 |

EXAMPLE 6

Samples of bright filler tobacco were treated at five different feed OV values and three different treatment temperatures for each feed OV value. The feed rate of each sample was 180 g/min. and each sample was contacted with 100% steam in a 3" tower, equipped with a cyclone separator. The steam velocity was about 130 ft/sec. and the total contact time was about 4 seconds. The treated samples were equilibrated and the equilibrium CV and OV values for each sample calculated. Additionally, as a control, a portion of the bright filler tobacco at each feed OV was not treated but was equilibrated and the equilibrium CV and OV values measured. The results are presented in Table V below.

TABLE V

| Feed OV, % | Eq. CV/OV (cc/10g/%) of Untreated Control | Equ. CV/OV (cc/10g/%) 550° F. | 625° F. | 675° F. |
|---|---|---|---|---|
| 8 | 40/12 | 68/10 | 91/10 | 113/9 |
| 11 | 41/12 | 73/10 | 88/10 | 113/9 |
| 18 | 42/12 | 72/10 | 79/10 | 107/10 |
| 25 | 43/12 | 68/10 | 75/10 | 95/10 |

TABLE V-continued

| Feed OV, % | Eq. CV/OV (cc/10g/%) of Untreated Control | Equ. CV/OV (cc/10g/%) 550° F. | 625° F. | 675° F. |
|---|---|---|---|---|
| 28 | 44/12 | 67/10 | 80/10 | 89/10 |

EXAMPLE 7

Samples of bright filler were contacted with 100% steam in a 3" tower, equipped with a cyclone separator, and other samples were contacted with 72% steam in an 8" tower, equipped with a tangential separator, at three different feed rates and four different treatment temperatures. The steam velocity was about 125 ft/sec. and the total contact time was about 4 seconds. As a control, a portion of the sample used for each feed rate was not treated but was equilibrated and the equilibrium CV and OV values determined. The equilibrium CV and OV values for each treated sample were determined. As a comparative example, samples were contacted with hot air containing no steam in a 3" tower equipped with a cyclone separator at two different feed rates. The results are summarized in Table VI below.

TABLE VI

| Feed Rate of Bright Filler at 11% OV | Equ. CV/OV, (cc/10g/%) of untreated Bright Filler Control | $CV_{eq}/OV_{eq}$/Exit OV (cc/10g/%/%) 550° F. | 600° F. | 625° F. | 675° F. |
|---|---|---|---|---|---|
| | | 3" Tower/100% Steam | | | |
| 180g/min | 41/12 | 67/11/2.7 | — | 90/10/2.2 | 104/10/2.0 |
| 1080g/min | 41/12 | 59/11/2.8 | — | 69/11/1.9 | 81/11/1.9 |
| | | 8" Tower/72% Steam | | | |
| 3⅛ lbs/min | 35/12.3 | — | 53.5/10.9/— | — | — |
| 1½ lbs/min | 35/12.3 | — | 66.6/10/— | — | — |
| Comparative Example | | | | | |
| | | 3" Tower/0% Steam | | | |
| 180g/min | 41/12 | 49/11/2.5 | — | — | — |
| 1080g/min | 41/12 | 42/11/3.7 | — | — | — |

EXAMPLE 8

Samples of cased burley filler were contacted with 100% steam in a 3" tower, equipped with a cyclone separator, at a feed rate of 180 g/min, at five different tower temperatures and two different feed OV values, and the tower exit OV values determined. The steam velocity was about 130 ft./sec. and the total contact time was about 4 seconds. Each treated sample, as well as untreated controls, were equilibrated and the equilibrium CV and OV values determined. The results are summarized in Table VII below.

TABLE VII

| Feed OV, % | Treatment Temperature | Tower Exit OV, % | Equ. CV/OV cc/10g/% |
|---|---|---|---|
| Untreated control | — | — | 34/13.0 |
| 20 | 450° F. | 5.3 | 47/12.0 |
| 20 | 550° F. | 3.2 | 58/10.8 |
| 20 | 600° F. | 3.0 | 61/11.0 |
| 20 | 650° F. | 2.6 | 72/10.6 |
| 20 | 675° F. | 2.7 | 82/10.3 |
| Untreated control | — | — | 36/12.6 |
| 11 | 450° F. | 3.0 | 43/11.6 |
| 11 | 550° F. | 2.5 | 58/10.5 |
| 11 | 600° F. | 1.9 | 63/10.7 |
| 11 | 650° F. | 1.8 | 80/10.3 |

TABLE VII-continued

| Feed OV, % | Treatment Temperature | Tower Exit OV, % | Equ. CV/OV cc/10g/% |
|---|---|---|---|
| 11 | 675° F. | 1.9 | 85/10.2 |

EXAMPLE 9

Samples of bright filler tobacco were contacted with steam in a 3" tower, equipped with a cyclone separator, and other samples contacted with steam in an 8" tower, equipped with a tangential separator, each at two different feed OV values and the tower treatment temperatures and percent steam varied. The feed rate for each type of tower was held constant. The steam velocity was about 125 ft./sec. and the total contact time was about 4 seconds. The equilibrium CV and OV values, as well as the equilibrium sample SV, for each treated sample and for untreated controls were determined. The results are summarized in Table VIII below.

TABLE VIII

| Tower Type/ Treatment Temperature | Exit OV, % | % Steam Atmosphere | Equ. CV/OV cc/10g/% | Equ. Sample SV cc/g | Feed Rate lbs./min. |
|---|---|---|---|---|---|
| 11% Feed OV | | | | | |
| Untreated control | — | — | 37/12 | 0.94 | — |
| 3"/550° F. | 2 | 99 | 64/11 | 1.66 | 0.4 |
| 3"/550° F. | 2.4 | 83 | 61/11 | 1.67 | 0.4 |
| 8"/550° F. | 2.2 | 73 | 52/11 | 1.48 | 3⅛ |
| 3"/625° F. | 1.5 | 99 | 84/10 | 2.22 | 0.4 |
| 3"/625° F. | 1.7 | 83 | 89/10 | 2.22 | 0.4 |
| 8"/600° F. | 2.0 | 73 | 61/10 | 1.93 | 3⅛ |
| 3"/675° F. | 1.4 | 99 | 102/10 | 2.54 | 0.4 |
| 3"/675° F. | 1.5 | 83 | 95/10 | 2.75 | 0.4 |
| 8"/640° F. | 1.8 | 73 | 74/10 | 2.33 | 3⅛ |
| 18% Feed OV | | | | | |
| Untreated control | — | — | 35/12 | 0.93 | — |
| 3"/550° F. | — | 99 | 59/11 | 1.56 | 0.4 |
| 3"/550° F. | — | 85 | 62/11 | 1.52 | 0.4 |
| 8"/550° F. | — | 72 | 43/12 | 1.42 | 3⅛ |
| 3"/625° F. | — | 99 | 74/11 | 1.92 | 0.4 |
| 3"/625° F. | — | 85 | 77/11 | 1.99 | 0.4 |
| 8"/600° F. | — | 72 | 47/11 | 1.56 | 3⅛ |
| 3"/675° F. | — | 99 | 90/10 | 2.02 | 0.4 |
| 3"/675° F. | — | 85 | 98/10 | 2.38 | 0.4 |
| 8"/640° F. | — | 72 | 58/11 | 1.77 | 3⅛ |

EXAMPLE 10

To evaluate the effect that the method of equilibration has on the equilibrium CV and OV values of tobacco filler treated according to the process of the present invention, samples of bright filler tobacco were contacted with 100% steam at two different temperatures in a 3" tower equipped with a cyclone separator. The feed rate was held constant at 180 g/min, the initial OV value was 11.4%, the steam velocity was about 130 ft./sec. and the total contact time was about 4 seconds. Portions of each treated sample were then equilibrated in three different ways. One portion was equilibrated in moist air at 60% relative humidity (RH) and 72° F. The second portion was equilibrated by spraying with water to establish an OV value of 10% and then sealed in bags for about 14 hours to about 16 hours, and then conditioned in a room at 60% RH and 72° F. for 24 hours. The third portion was equilibrated by super wetting to an OV value of 30% and then equilibrated at 60% RH and 72° F. The equilibrium CV and OV values for each portion of each sample, as well as for an untreated control, were determined and the results are reported in Table IX below.

TABLE IX

| | Equ. CV/OV (cc/10g/%) of Tower Treated Bright Filler After Equilibration: | | |
|---|---|---|---|
| Treatment Temperature | Moist Air 60% RH, 72° F. | Spraying Water to 10% OV | Super Wetting, 30% OV and then Equilibrated at 60% RH, 72° F. |
| Untreated Control | 41/11 | — | 44/11 |
| 625° F. | 90/10 | 82/11 | 74/11 |
| 675° F. | 104/10 | 95/11 | 90/11 |

EXAMPLE 11

To evaluate the effect of aging on the equilibrium CV and OV values, a quantity of uncased bright filler (lamina) was obtained immediately after it had been cut on a Legg cutter. This filler was determined to have an OV value within the range of from about 18% to about 20%. A portion of this cut filler was sealed in polyethylene bags at about 18% to about 20% OV and stored in a refrigerator at 35° F. for four days to age. A second portion of the cut filler was contacted, immediately after cutting, with 100% steam in a 3" expansion tower, equipped with a cyclone separator, at two different temperatures, a feed rate of 180 g/min., a steam velocity of about 130 ft./sec. and for a total contact time of about 4 seconds. At the end of the four-day aging period, the first portion was treated under identical conditions. The treated samples, as well as an untreated control for the unaged and aged portions, were equilibrated and the equilibrium CV and OV values determined. The percent increase in the CV value over that of the control was calculated. The results are summarized in Table X below.

TABLE X

| EFFECT OF AGING OF CUT FILLER ON ABILITY TO EXPAND | | | | | |
|---|---|---|---|---|---|
| | Treatment Temperature | Tower Feed OV, % | Exit OV, % | CV/OV cc/10g/% | Increase in CV, % |
| Unaged Tobacco | | | | | |
| Untreated | — | — | — | 33/11 | — |

TABLE X-continued

| EFFECT OF AGING OF CUT FILLER ON ABILITY TO EXPAND | | | | | |
|---|---|---|---|---|---|
| | Treatment Temperature | Tower Feed OV, % | Exit OV, % | CV/OV cc/10g/% | Increase in CV, % |
| control | | | | | |
| | 550° F. | 18 | 4 | 58/10 | 76 |
| | 625° F. | 18 | 3 | 65/11 | 97 |
| Aged Tobacco | | | | | |
| Untreated control | — | — | — | 35/12 | — |
| | 550° F. | 18 | 2 | 59/11 | 69 |
| | 625° F. | 18 | 2 | 74/11 | 111 |

EXAMPLE 12

To evaluate the effect that casing the tobacco filler has on the percent increase in the $CV_{eq}$ value over the $CV_{eq}$ value of untreated filler, portions of freshly cut bright and burley fillers were contacted with 100% steam in a 3" tower, equipped with a cyclone separator, at a feed rate of 180 g/min., and a steam velocity of about 130 ft./sec., for a total contact time of about 4 seconds. The feed OV value was within the range of from about 18% to about 20%. For each tobacco type, a portion was cased and then samples of both the cased and uncased were treated, as noted above, at two different temperatures. The exit OV value of the treated samples was determined and the samples then equilibrated. The equilibrium CV and OV values for each treated sample, as well as for untreated controls, were determined and the percent increase in equilibrium CV over that of the control calculated. The results are summarized in Table XI below and indicate that the process of the present invention may be applied equally well to cased fillers, to uncased fillers, and to blends.

TABLE XI

| Tobacco Type | Treatment Temperature | Tower Exit OV % | Equ. CV/OV cc/10g/% | Equ. CV Increase % |
|---|---|---|---|---|
| Uncased Bright | | | | |
| Untreated control | — | — | 33/11 | — |
| | 550° F. | 4 | 58/10 | 76 |
| | 625° F. | 3 | 65/11 | 97 |
| Cased Bright | | | | |
| Untreated control | — | — | 25/15* | — |
| | 550° F. | 9 | 44/12 | 76 |
| | 625° F. | 4 | 56/12 | 124 |
| Uncased Burley | | | | |
| Untreated control | — | — | 37/12 | — |
| | 550° F. | 5 | 68/10 | 84 |
| | 625° F. | 3 | 76/10 | 105 |
| Cased Burley | | | | |
| Untreated control | — | — | 35/12 | — |
| | 550° F. | 4 | 59/11 | 68 |
| | 625° F. | 2 | 72/10 | 105 |

*Not fully equilibrated.

EXAMPLE 13

The effect of reordering on equilibrium CV and OV values of bright filler was evaluated by contacting some samples with steam in a 3" tower and other samples with steam in an 8" tower at two different feed OV values while varying the temperature and percent steam in the towers and then, for each treated sample, reordering a portion without equilibration and determining the CV and OV values, and, for another portion, reordering and equilibrating before determining the CV and OV values. The steam velocity was about 125 ft./sec., the total contact time was about 4 seconds. The feed rate was about 0.4 lbs./min. in the 3" tower equipped with a cyclone separator, and about 3⅛ lbs./min. in the 8" tower, equipped with a tangential separator. The results are summarized in Table XII below.

TABLE XII

EFFECT OF REORDERING ON EQU. CV/OV, cc/10g/% OF TOWER TREATED BRIGHT FILLER

| Tower Type/ Treatment Temperature | Feed OV % | % Steam Atmosphere | Reordering as is CV/OV, cc/10g/% | Reordered/Equilibrated CV/OV, cc/10g/% |
|---|---|---|---|---|
| 3"/550° F. | 11 | 99 | 83/8 | 64/11 |
| 3"/550° F. | 11 | 83 | 82/9 | 61/11 |
| 8"/550° F. | 11 | 73 | 60/9 | 49/11 |
| 3"/625° F. | 11 | 99 | 70/12 | 79/11 |
| 3"/625° F. | 11 | 83 | 98/8 | 83/10 |
| 8"/600° F. | 11 | 73 | 54/12 | 58/11 |
| 3"/675° F. | 11 | 99 | 122/7 | 100/10 |
| 3"/675° F. | 11 | 83 | 104/8 | 95/10 |
| 8"/640° F. | 11 | 73 | 63/11 | 68/10 |
| 8"/550° F. | 18 | 72 | 55/10 | 44/11 |
| 8"/600° F. | 18 | 72 | 60/10 | 53/11 |
| 8"/640° F. | 18 | 72 | 56/11 | 58/11 |

EXAMPLE 14

To evaluate the effect of additives on the post-treatment equilibrium CV and OV values of burley filler, samples treated with the additives and amounts thereof indicated in Table X, as well as a control without any additives, were contacted with 100% steam in a 3" tower, equipped with a cyclone separator, at a feed rate of 180 g/min., a steam velocity of 130 ft./sec. and for a total contact time of about 4 seconds. Portions of each sample were treated at three different tower temperatures. The samples were equilibrated, as was an untreated portion of the sample, and the equilibrium CV and OV values determined. The results are summarized in Table XIII below.

TABLE XIII

| ADDITIVE Type and Level | Equ. CV/OV of Unexpanded Filler, cc/10g/% | Equ. CV/OV, cc/10g/% 550° F. | 625° F. | 675° F. |
|---|---|---|---|---|
| None (Control) | 43/11 | 70/10 | 84/10 | 101/10 |
| Glycerine, 2% | 35/13 | 59/11 | 69/11 | 77/10 |
| Glycerine, 4% | 31/14 | 55/11 | 64/11 | 81/11 |
| Citric Acid, 5% | 44/11 | 69/10 | 87/10 | 106/9 |
| Glycerine 2% + Citric Acid, 5% | 32/13 | 53/11 | 71/11 | 77/10 |
| Glycerine 4% + Citric Acid, 5% | 30/13 | 50/11 | 62/11 | 81/10 |

EXAMPLE 15

The filler size distribution of tobacco treated according to the process of the present invention was determined after contacting samples of bright filler, at two different feed OV values, with 75% steam in an 8" tower, equipped with a tangential separator, at a feed rate of 3⅛ lbs/min. and at three different temperatures. The steam velocity was about 125 ft./sec. and the total contact time was about 4 seconds. A portion of each treated sample was equilibrated and another portion of each treated sample was reordered by spraying. The filler size distribution was determined for controls as well as for each equilibrated and each reordered sample, and the percent of each sample that was one of five sizes, by sieve analysis, was recorded. The results are summarized in Table XIV below.

TABLE XIV

| Feed OV, % | 11 | | | | 18 | | | |
|---|---|---|---|---|---|---|---|---|
| | Untreated Control | 550° F. | 600° F. | 640° F. | Untreated Control | 550° F. | 600° F. | 640° F. |
| Sieve Size | % that Sieve Size | | | | % that Sieve Size | | | |
| | | | Equilibrated Filler | | | | | |
| long | 34.2 | 32.8 | 36.9 | 31.5 | 30.6 | 43.0 | 40.0 | 43.9 |
| medium | 51.8 | 55.0 | 53.0 | 58.2 | 55.6 | 47.2 | 49.4 | 48.8 |
| short | 11.6 | 11.0 | 8.8 | 8.6 | 11.3 | 8.1 | 8.2 | 6.0 |
| small | 0.5 | 0.3 | 0.3 | 0.4 | 0.3 | 0.2 | 0.7 | 0.2 |
| fine | 1.8 | 1.4 | 0.8 | 1.3 | 2.4 | 1.6 | 1.6 | 1.1 |
| | | | Reordered Filler | | | | | |
| long | | 36.6 | 34.0 | 31.9 | | 36.0 | 33.9 | 37.3 |
| medium | | 52.4 | 55.6 | 57.2 | | 54.2 | 55.6 | 53.4 |
| short | | 9.6 | 8.8 | 9.4 | | 8.5 | 9.4 | 8.0 |
| small | | 0.4 | 0.4 | 0.4 | | 0.3 | 0.3 | 0.3 |
| fine | | 1.0 | 1.2 | 1.2 | | 1.0 | 1.0 | 1.0 |

As the results indicate, the filler size distribution of treated filler compares very favorably to the filler size distribution of untreated controls.

EXAMPLE 16

Seven samples of uncased bright filler tobacco were contacted with steam in a 24" tower, equipped with a tangential separator and various pre-treatment and post-treatment parameters measured and recorded. The total contact time was about 8 seconds. The treatment conditions are reported and the results are summarized in Table XV below.

TABLE XV

| | SAMPLE NUMBER 1 | 2 | 3 | 4 | 5 | 6 | 7 |
|---|---|---|---|---|---|---|---|
| Pre-Treatment | | | | | | | |
| Feed Equ. OV, % | 12.67 | 12.45 | 12.29 | 12.16 | 12.41 | 12.41 | 12.66 |
| Feed Equ. SV, cc/g | 0.94 | 0.96 | 0.94 | 0.95 | 0.95 | 0.96 | 0.93 |
| Feed Equ. CV, cc/10g | 32.1 | 32.9 | 32.9 | 31.4 | 31.6 | 31.9 | 33 |

TABLE XV-continued

| | SAMPLE NUMBER | | | | | | |
|---|---|---|---|---|---|---|---|
| | 1 | 2 | 3 | 4 | 5 | 6 | 7 |
| Treatment | | | | | | | |
| Feed Rate (lbs./min.) | 3.6 | 3.6 | 2.2 | 2.2 | 2.2 | 2.2 | 3.3 |
| Feed OV, % | 12–13 | 12–13 | 12–13 | 12–13 | 12–13 | 12–13 | 19.2 |
| Temperature | 600° F. | 650° F. | 600° F. | 650° F. | 675° F. | 650° F. | 675° F. |
| Velocity of Steam in Tower, feet/sec. | 137 | 137 | 137 | 137 | 137 | 110 | 137 |
| Steam Atmosphere, % | 80 | 80 | 80 | 80 | 80 | 80 | 71 |
| Tower Exit | | | | | | | |
| Exit OV, % | 1.38 | 1.01 | 1.61 | 1.03 | 0.71 | 0.96 | 2.50 |
| Exit SV, % | 1.32 | 1.49 | 1.39 | 1.61 | 1.75 | 1.60 | 1.42 |
| Equ. OV, % | 11.41 | 10.68 | 10.89 | 10.10 | 9.97 | 11.04 | 11.86 |
| Equ. SV, cc/g | 1.13 | 1.31 | 1.22 | 1.40 | 1.57 | 1.26 | 1.29 |
| Equ. CV, cc/10g | 37.9 | 46.1 | 40.8 | 49.6 | 57.2 | 45.1 | 44.9 |
| Tower Treated, Cylinder Reordered | | | | | | | |
| OV, % | 8.68 | 12.12 | 10.60 | 10.94 | 11.15 | 10.40 | 10.42 |
| SV, cc/g | 1.20 | 1.20 | 1.17 | 1.34 | 1.52 | 1.30 | 1.30 |
| CV, cc/10g | 57.5 | 38.7 | 42.9 | 48.0 | 51.4 | 48.7 | 50.7 |
| Equ. OV, % | 11.58 | 11.04 | 10.95 | 10.32 | 10.26 | 12.32 | 11.99 |
| Equ. SV, cc/g | 1.16 | 1.13 | 1.17 | 1.30 | 1.34 | 1.23 | 1.28 |
| Equ. CV, cc/10g | 37.2 | 40.3 | 38.6 | 47.6 | 52.6 | 43.9 | 41.1 |

We claim:

1. A single step process for increasing the filling power of tobacco lamina filler comprising contacting tobacco lamina filler with a heat transfer medium such that heat is rapidly and substantially uniformly transferred from the medium to the filler for a total contact time sufficient to stiffen and expand said filler, said filler being free of exogenous impregnants immediately before being contacted with said medium, having an OV value, immediately before being contacted with said medium, within the range of from about 8% to about 30%, and having an OV value, immediately after being contacted with said medium, of less than about 5%.

2. The process of claim 1, wherein the OV value, immediately before treatment, is within the range of from about 10% to about 20%.

3. The process of claim 1, 2 wherein the OV value, immediately before treatment, is within the range of from about 10% to about 14%.

4. A single step process for increasing the filling power of tobacco lamina filler comprising contacting tobacco lamina filler with a heat transfer medium comprising a high velocity gas at elevated temperature by substantially uniformly dispersing the filler therein such that heat is rapidly and substantially uniformly transferred from the medium to the filler for a total contact time sufficient to stiffen and expand said filler, said filler being free of exogenous impregnants immediately before being contacted with said medium, having an OV value, immediately before being contacted with said medium, within the range of from about 8% to about 30%, and having an OV value, immediately after being contacted with said medium, of less than about 5%.

5. The process of claim 4 wherein the gas comprises at least about 50% steam.

6. The process of claim 5 wherein the gas is at a temperature of at least about 450° F.

7. The process of claim 4 wherein the total contact time is from about 1 to about 6 seconds.

8. A single step process for increasing the filling power of tobacco lamina filler comprising substantially uniformly exposing tobacco lamina filler to radiant energy such that radiant energy is rapidly and substantially uniformly transferred to said filler for a total exposure time sufficient to stiffen and expand said filler, said filler being free of exogenous impregnants immediately before being exposed to said radiant energy, having an OV value, immediately before being exposed to said radiant energy, within the range of from about 8% to about 30%, and having an OV value, immediately after being exposed to said radiant energy, of less than about 5%.

9. The process of claim 1, 4, or 8 including reordering the expanded filler.

10. A stiffened and expanded tobacco lamina filler produced according to the process of claim 1, 4, or 8.

* * * * *

UNITED STATES PATENT AND TRADEMARK OFFICE

CERTIFICATE OF CORRECTION

PATENT NO. : 4,414,987

DATED : November 15, 1983

INVENTOR(S) : Francis V. Utsch et al

It is certified that error appears in the above-identified patent and that said Letters Patent is hereby corrected as shown below:

Claim 2, "The process of claim 1," should be --The process of claim 1, 4, or 8--.

Claim 3, "The process of claim 1, 2" should be --The process of claim 1, 4, or 8--.

Signed and Sealed this

*Fifth* Day of *March 1985*

[SEAL]

*Attest:*

DONALD J. QUIGG

*Attesting Officer* *Acting Commissioner of Patents and Trademarks*